US005975221A

United States Patent [19]

Püttmann

[11] Patent Number: 5,975,221

[45] Date of Patent: Nov. 2, 1999

[54] MACHINE FOR HORIZONTAL PERCUSSION BORING

[75] Inventor: Franz-Josef Püttmann, Lennestadt, Germany

[73] Assignee: Tracto-Technik Paul Schmidt Spezialmaschinen, Lennestadt, Germany

[21] Appl. No.: 08/956,855

[22] Filed: Oct. 23, 1997

[30] Foreign Application Priority Data

Nov. 2, 1996 [DE] Germany ..... 196 45 222

[51] Int. Cl.[6] ..... E21B 1/02

[52] U.S. Cl. ..... 175/135; 173/131

[58] Field of Search ..... 175/19, 122, 135, 175/293; 173/90, 91, 93, 126, 128, 131, 135

[56] References Cited

U.S. PATENT DOCUMENTS

| | | | |
|---|---|---|---|
| 4,690,226 | 9/1987 | Schnizler et al. | 175/414 X |
| 5,010,965 | 4/1991 | Schmelzer | 175/19 |
| 5,289,887 | 3/1994 | Püttmann | 175/61 |
| 5,310,014 | 5/1994 | Mueller | 175/171 |

FOREIGN PATENT DOCUMENTS 28 24 722 4/1981 Germany .

*Primary Examiner*—Roger Schoeppel
*Attorney, Agent, or Firm*—Merchant & Gould P.C.

[57] ABSTRACT

In a machine for horizontal or inclined percussion boring in the ground having a percussion boring string which has an oblique-face boring head at one end and an impact mechanism at the other end, the impact mechanism is mounted beside the rotary drive in order to reduce the length of the machine.

12 Claims, 5 Drawing Sheets

MACHINE FOR HORIZONTAL PERCUSSION BORING

FIELD OF THE INVENTION

The invention relates to a percussion boring machine, more particularly for producing horizontal or inclined earth bores. Such machines consist essentially of a boring string made up of individual sections connected together, with a boring head at one end and a drive at the other end. For directed boring a steering head, for example with an oblique face, may be provided as the boring head. The rotary drive for the string is usually mounted on a carriage which in turn is connected to a feed drive. In order to make superimposed boring possible, an impact mechanism, likewise connected to the string, can also be mounted on the carriage.

BACKGROUND AND PRIOR ART

A machine of the abovementioned kind is known from German specification 41 03 196. In the case of this machine the rotary drive and the impact mechanism are mounted one behind the other in the direction of the axis of the string. For many applications the space requirement that results from this does not play any significant part. It is otherwise, however, if it is desired to start boring from a building or starting trench. When crossing underneath roads the starting trench is often restricted to the breadth of the pavement or else of a front garden. In such tight spaces it is often not possible to use boring machines having the conventional arrangement of the rotary drive arid the impact mechanism.

OBJECT OF THE INVENTION

The object of the invention is therefore to overcome this disadvantage and provide a boring machine of shorter construction.

SUMMARY OF THE INVENTION

To this end it is proposed in accordance with the invention to arrange the rotary drive and at least one impact mechanism side by side. In this way the length of the string drive is decreased by the dimensions of the rotary drive (which is usually shorter) substantially to the length of the impact mechanism. In practice this amounts to a shortening of the string drive by about 50%.

The term impact mechanism is to be understood as including mechanical, pneumatic and hydraulic impact mechanisms and also vibratory devices. The impact mechanism is of particular importance when travelling round a curve, since the normal thrust is then often inadequate owing to the increased ground resistance.

Preferably there is an impact mechanism mounted on either side of the rotary drive arranged on the axis of the string. The impact mechanisms can act on a yoke arranged in front of or behind the rotary drive and connected to the string or to the rotary drive, but they can also be arranged around the rotary drive in the form of a star.

The impact mechanism may be arranged to pivot about the shaft of the rotary drive. This enables the impact mechanism, or several such mechanisms, to be brought into a suitable position for the machine to be used in the particular spatial conditions. Thus in a shallow space two impact mechanisms can be arranged on opposite sides of the axis of the string in a horizontal plane, and in a narrow space they can be arranged in a vertical plane.

The impact mechanism can also be mounted in the thrust carriage releasably or so as to be pivotable laterally or upwards in order to reduce the space needed in the particular case, for example for a short time after coupling on a new section of pipe. Of course, the impact mechanism can then not be used for a short period, until it is swung back again into its operating position.

Furthermore the impact mechanism and the rotary drive can also be arranged away from the axis of the string, i.e. eccentrically, in order to arrange as many components as possible side by side which would otherwise have to be arranged one behind the other on the axis of the string. Finally, it is also possible to arrange the impact mechanism centrally and the rotary drive eccentrically in order to decrease the length of the machine.

To make it possible to perform directed boring and, for example, to create a curved borehole passing round an underground obstruction or a pipeline laid in the ground, the string can be provided with a steering head, for example an oblique-face drill head, which rotates while boring straight ahead but is stopped while travelling round a curve and diverts the tip of the boring string towards the side opposite the oblique face.

Hydraulic impact mechanisms, which are marked by low energy consumption and low noise emission, are particularly suitable for the device in accordance with the invention.

The impact mechanism and/or the rotary drive can also be arranged to be slidable axially in the carriage.

BRIEF DESCRIPTION OF THE DRAWINGS

The invention will now be described in more detail with reference to exemplary embodiments shown in the drawings, in which.

DETAILED DESCRIPTION OF PREFERRED EMBODIMENTS OF THE INVENTION

Figure 1:
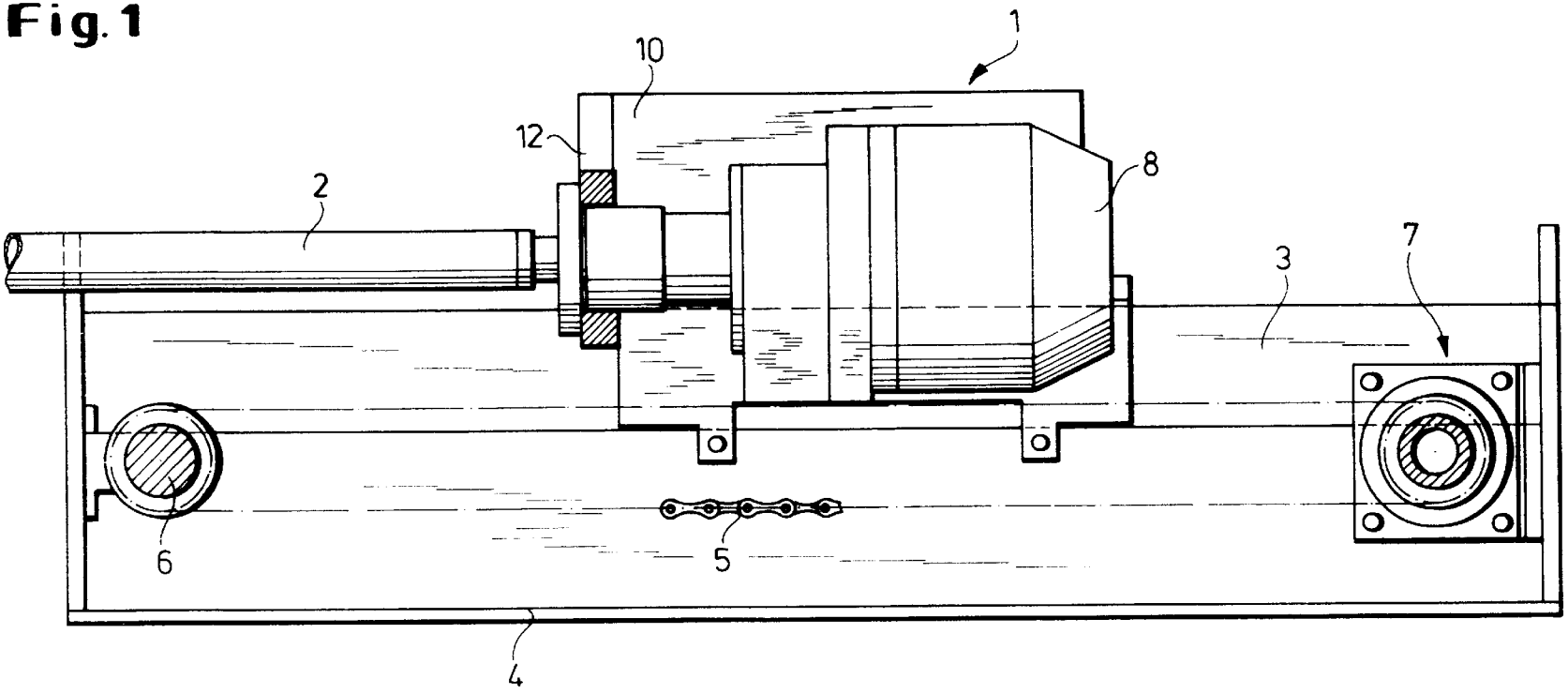
FIG. 1 shows a side view of a boring machine with a carriage.
Figure 2:
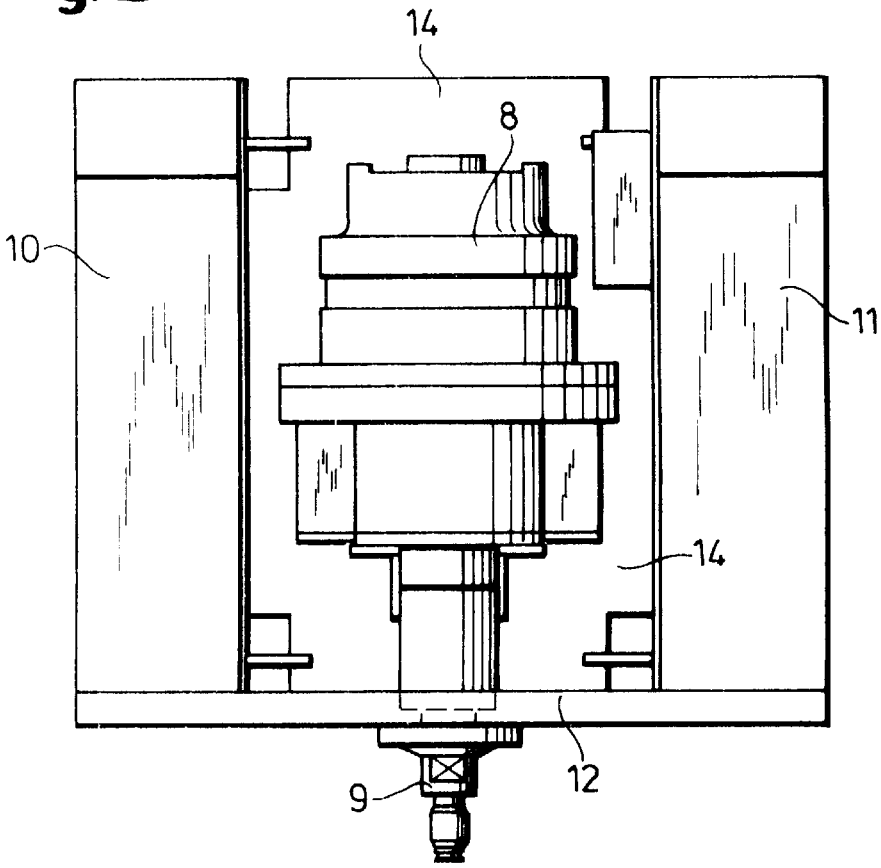
FIG. 2 shows a top view of the machine of FIG. 1.
Figure 3:
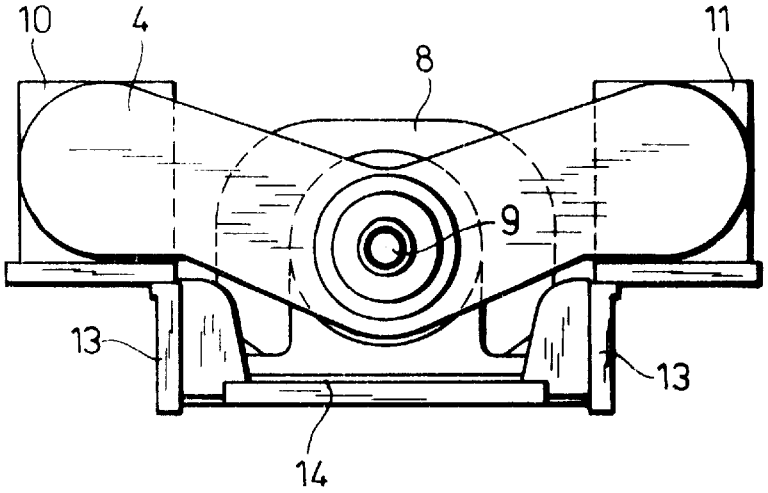
FIG. 3 shows a front end view of the machine of FIGS. 1 and 2.

The boring machine consists essentially of a rotary-and-percussion drive 1, in the form of a slide, for a boring string 2 which for example in the case of boring with a flushing fluid is provided with an oblique-face boring head such as is described in respect of construction and mode of operation in German specification 39 11 467 in a manner which sufficiently amplifies the present description.

The driving unit is mounted by means of guides (not shown) to travel on rails 3 of a carriage 4 and is connected by chains 5 and chain wheels 6 to a thrust or forward feed drive 7.

The forward feed drive moves the slide 1 in the direction of advance as far as a left-hand end position in which the string coupling 9 is released. The slide then travels back into its right-hand end position in order to enable a new section of pipe to be inserted between the string 2 and the string coupling 9.

The string drive 1 consists essentially of a rotary drive 8 in the form of a motor having its shaft connected to a string coupling 9. On each side of the rotary drive 8 is mounted a respective hydraulic impact mechanism 10, 11. The strikers (not shown) of the impact mechanisms 10, 11 act on a V-shaped yoke 12 which connects the two impact mechanisms together and is in turn connected to the rotary drive 8. The rotary drive 8 and the two impact mechanisms are mounted on a common base plate 14 by means of brackets 13, together with which they form a kind of slide.

Figure 4:
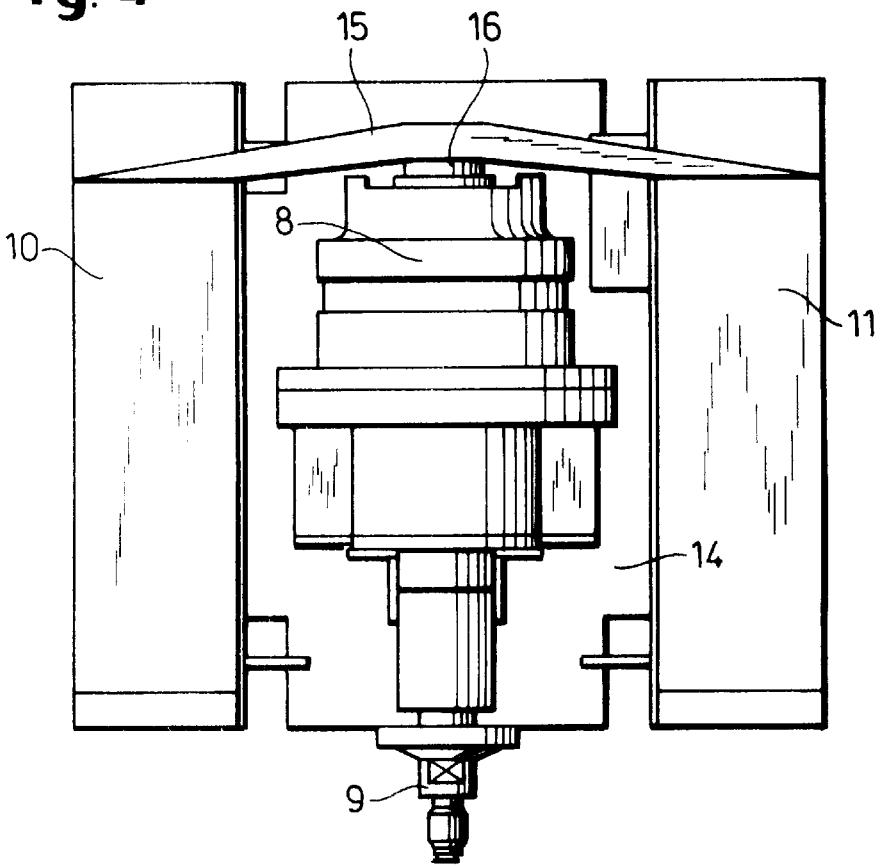
FIG. 4 shows a top view of another string drive.
Figure 5:
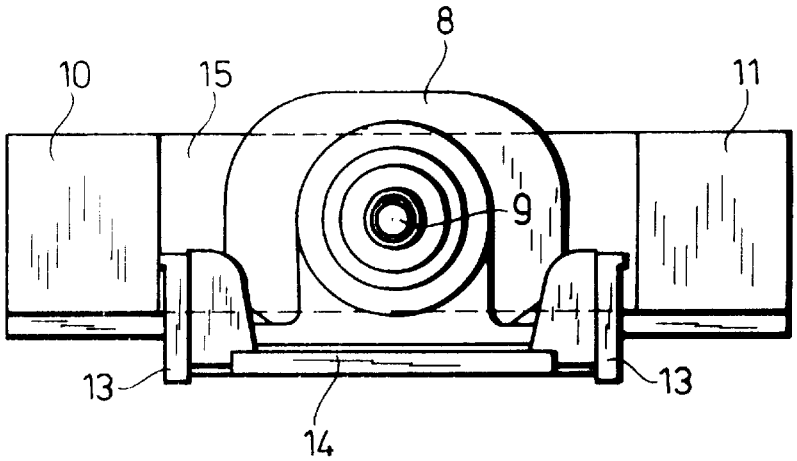
FIG. 5 shows a front end view of the string drive of FIG. 4.

In the exemplary embodiment shown in FIG. 4 the yoke connecting the impact mechanisms 10, 11 together and to the rotary drive 8 is located at the end of the rotary drive remote from the string 7. The obtuse-angled yoke 15 acts through a pin 16 and the housing of the rotary drive 18 on the string coupling 9 arid thereby directly on the string.

Figure 6:
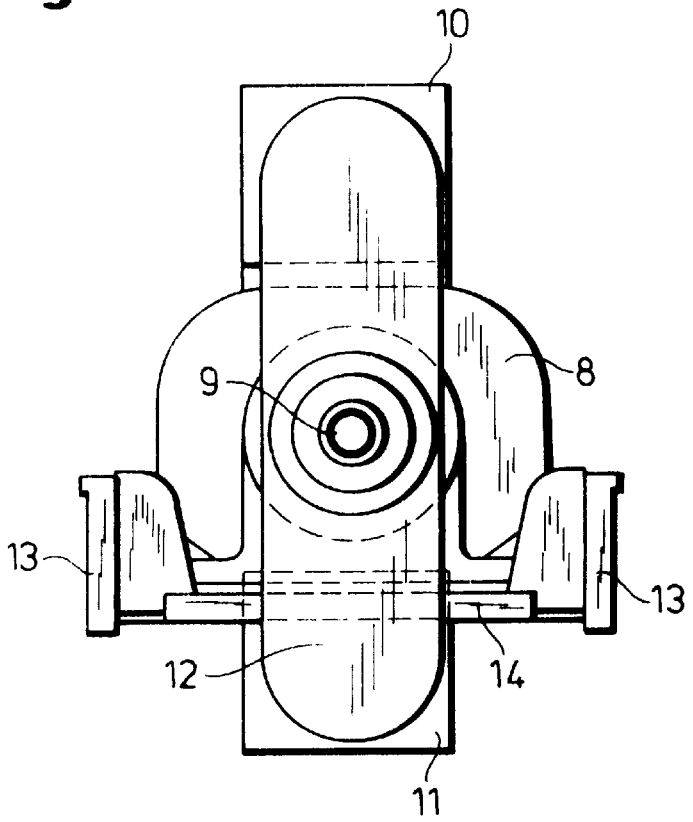
FIG. 6 shows the front end view of a string drive having another arrangement of the impact mechanism.

In the case of the exemplary embodiment shown in FIG. 6 the impact mechanisms 10, 11 are not arranged side by side but one above the other. Otherwise the string drive does not differ substantially from the two string drives previously described.

The invention also permits the variants in the drive shown in FIGS. 1 to 3 and 4, 5 on the one hand and in FIG. 6 on the other hand to be combined in a single unit. For this purpose the two impact mechanisms 10, 11 and the yoke 12, 15 merely need to be mounted to rotate about the motor axis and the slide to be made such that it permits rotation of the unit 10, 11, 12 or 10, 11, 15 and if desired also the rotary drive 8, about the axis of the rotary drive 8. In this way it is possible to use one and the same apparatus in narrow trenches and spaces or in shallow spaces.

The impact mechanism can also be arranged in a frame of its own which is connected either releasably or pivotally to the slide. This gives the possibility of using the machine in a very narrow space. After introducing a new pipe section and connecting it to the string coupling 9 the machine can then first of all be used for a short time without the impact mechanism or with the impact mechanism swung away out of the horizontal. Then as soon as the slide has moved far enough in the direction of boring for there to be sufficient room behind the rotary drive the impact mechanism is brought into its operating position. In this variant of the invention it is solely the length of the rotary drive which determines the minimum dimensions of the starting trench, irrespective of the length of the impact mechanism.

Figure 7:
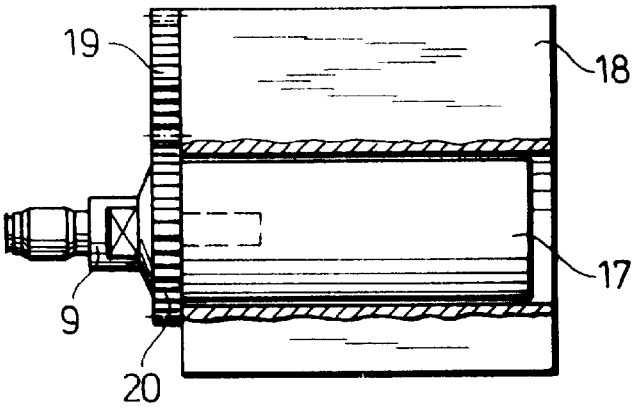
FIG. 7 shows a rotary-and-percussion drive with a central impact mechanism and FIG. 8 shows a rotary-and-percussion drive with an eccentrically mounted rotary drive.

Furthermore, as is shown diagrammatically in FIG. 7, an impact mechanism 17 can also be mounted centrally and a rotary drive 18 eccentrically. A gear wheel 19 mounted on the drive shaft then meshes with a gear wheel 20 which is non-rotatably connected to the string coupling 9.

Figure 8:
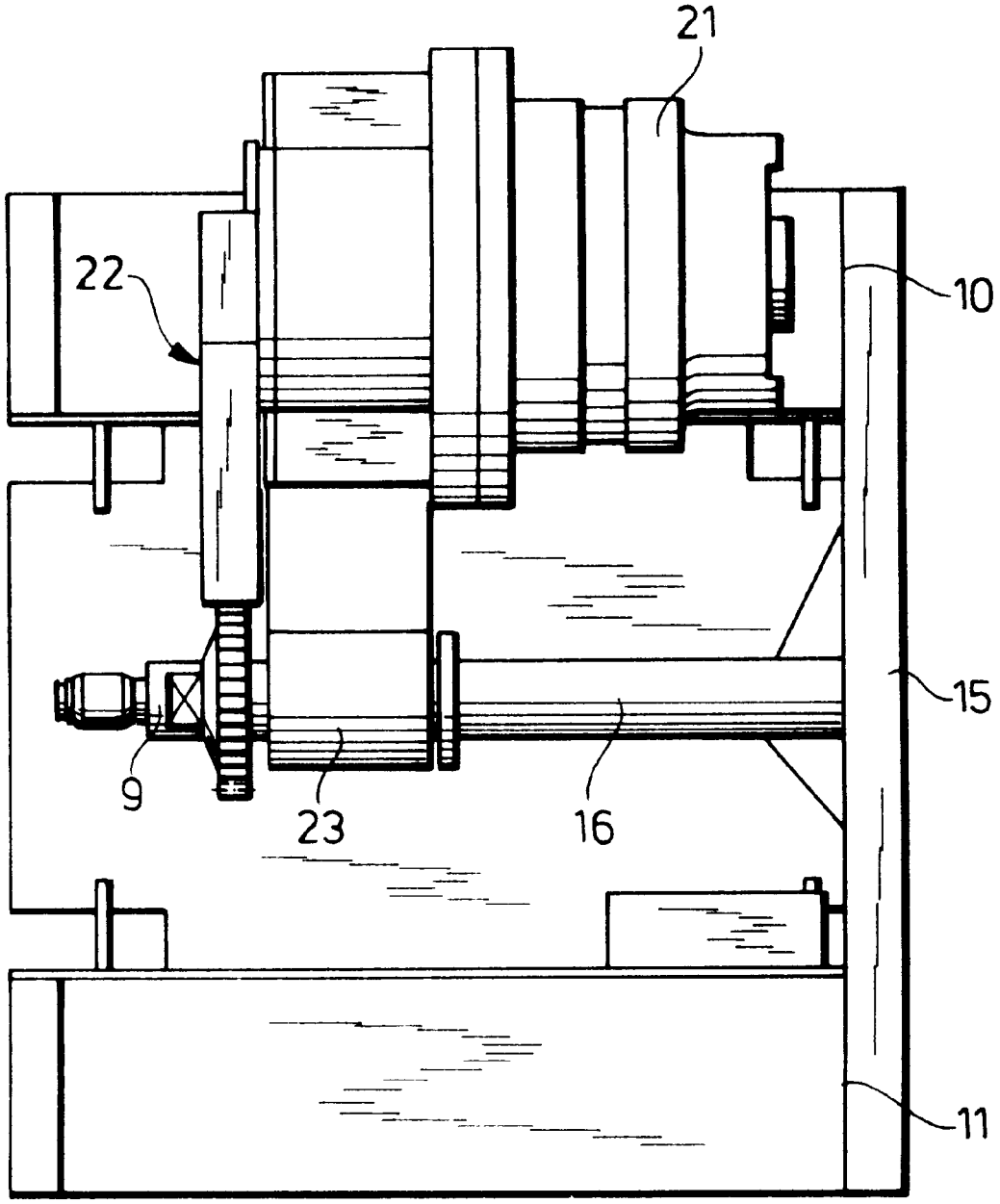

Finally a rotary drive 21 can also be arranged eccentrically, similarly to the impact mechanism 10, 11, and connected to the string coupling 9 via gearing 22 (FIG. 8). Those parts which are otherwise arranged with the rotary drive in the vicinity of the string axis, such as for example a connection 23 for the supply of drilling fluid, then remain in the space behind the string coupling 9. In addition a pin 16 which is connected to a yoke 15 is then arranged there.

What is claimed is:

1. A machine for horizontal or inclined percussion boring in the ground, comprising a rotary drive (8; 18; 21) for a percussion boring string (2) and at least one impact mechanism (10; 11; 17)arranged beside the rotary drive and/or the string.

2. A machine according to claim 1, wherein a respective impact mechanism (10; 11) is mounted on each side of the rotary drive (8).

3. A machine according to claim 1, wherein the impact mechanisms (10; 11) act on a yoke (12) mounted in front of the rotary drive (8; 21) in the direction of advance.

4. A machine according to claim 1, wherein the impact mechanism (10; 11) acts on a yoke (15) mounted behind the rotary drive (8; 21) in the direction of advance.

5. A machine according to claim 1, wherein the impact mechanism (10; 11) is mounted to rotate about the axis of the rotary drive (8).

6. A machine according to claim 1, wherein the rotary drive (8) and the impact mechanism (10; 11) are carried on at least one feed carriage (4).

7. A machine according to claim 1, wherein the impact mechanism (10; 11) is mounted releasably or pivotally in at least one feed carriage (4).

8. A machine according to claim 1, wherein the rotary drive (21) and the impact mechanism (10; 11) are mounted away from the string axis.

9. A machine according to claim 1, wherein the impact mechanism (17) is arranged centrally and the rotary drive (18; 21) is arranged eccentrically.

10. A machine according to claim 1, wherein at least one of the impact mechanism (8; 17; 21) and the rotary drive is arranged so as to be axially slidable.

11. A machine according to claim 1, wherein the percussion boring string (2) is provided with a steering head.

12. A machine according to claim 1, wherein the impact mechanism (10; 11) is hydraulic.

* * * * *